US006345557B1

(12) United States Patent
Kuo

(10) Patent No.: US 6,345,557 B1
(45) Date of Patent: Feb. 12, 2002

(54) ADJUNCT TO A SPEED SPANNER

(76) Inventor: Teng-Tang Kuo, No. 2, Lane 55, Li-Ching 1st St. Chi-Tu District, Keelung City (TW)

( * ) Notice: Subject to any disclaimer, the term of this patent is extended or adjusted under 35 U.S.C. 154(b) by 0 days.

(21) Appl. No.: 09/610,975

(22) Filed: Jul. 6, 2000

(51) Int. Cl.[7] ..... B25B 23/16
(52) U.S. Cl. ..... 81/177.2; 81/180.1
(58) Field of Search ..... 81/177.1, 177.2, 81/180.1

(56) References Cited

U.S. PATENT DOCUMENTS 2,713,281 A * 7/1955 Poteet ..... 81/177.2
2,719,042 A * 9/1955 Espy ..... 81/177.2
3,424,039 A * 1/1969 Scott ..... 81/177.2
3,766,811 A * 10/1973 Callahan ..... 81/177.2
3,996,821 A * 12/1976 Murray ..... 81/177.2
4,043,230 A * 8/1977 Scrivens ..... 81/177.2
4,566,357 A * 1/1986 Carossino ..... 81/177.2
4,738,167 A * 4/1988 Ball ..... 81/177.2 X

* cited by examiner

*Primary Examiner*—James G. Smith
(74) *Attorney, Agent, or Firm*—Bacon & Thomas, PLLC

(57) ABSTRACT

An adjunct device for a speed spanner. The adjunct device is an auxiliary device to facilitate coupling of an L-shape hexagonal spanner to the adaptor of a prime speed spanner. The adjunct device is one-piece in structure, topped by a hollow-set sleeving which protrudes eccentrically downwards to form an assembly mounting. The mounting is flanked by a graded hole which includes a chain of individually sized conterminous hexagonal holes to accommodate engagement by any of a number of differently sized hexagonal spanners, and in such case, the axis on the other side of such any hexagonal spanner will be just aligned to the axis of the sleeving, so that once the sleeving is engaged with the coupling adaptor on the part of the prime speed spanner, the L-shape hexagonal spanner may be readily rotated by manual operation with respect to the prime speed spanner.

12 Claims, 10 Drawing Sheets

ADJUNCT TO A SPEED SPANNER

BACKGROUND OF THE INVENTION (a) Field of the Invention

Design of adjunct to a speed spanner, more specifically the design for a conventional L-shape hexagonal spanner to be fitted to the coupling end of a conventional speed spanner so that composite manipulation is made possible to reduce the exertion of force on the part of the user.

(b) Description of the Prior Art

Conventionally, a speed spanner is structured such that down one end of the spanner there protrudes a rectangular or multilateral coupling adaptor linked to a ratchet otherwise provided in the same spanner, the ratchet being limited to run unilaterally by a unilateral limiting shoe, so that the adaptor may be planted into one out of a variety of differently sized sleevings, whereby fast swinging of the spanner in a given direction will suffice to unscrew a fixed nut what with the sleeving functioning simultaneously, which is well known in the art.

A deficiency with such a conventional art of execution is that, the sleeving employed for use with the speed spanner is for the most part restricted to be of a specific type, indeed, the sleeving in use must be of a straight rod type, as to the job-end of the sleeving, the mode or pattern is largely dictated by the structure of the nut or screw to be undone; that is why, to adapt to the coupling adaptor of such speed spanners, operators in the industry must complementarily fabricate a full line of different sizes of sleevings so that application is possible.

In the marketplace one will find, notwithstanding, in stock and in ample supply spanners of a fixed type or specification, especially true is the case of the so-called L shape hexagonal spanners. In use, this type of spanner is to be operated by taking the shorter side as the job-side, the user at work must turn the longer side while holding same; when the object to be worked on differs in-depth access, the longer side is taken as the job-side of the same L-shape hexagonal spanner, and the shorter side serves instead as the grip for the user to hold with. This then is an instance where the torque of exertion on the part of the user is too short to facilitate loosening, unscrewing, undoing of a nail object being worked on; also, where the L shape hexagonal spanner sets to work in a narrow space in which the object lies, the user would be denied the leverage to undo a nail or screw by spanning a full 360 degrees of rotation; so one is tempted to find a solution whereby it is feasible to install a conventional L shape hexagonal spanner to aforementioned speed spanner, so that the user may arrive at speedy undoing of a fixed object screw by conventional swinging mode of operation even in a narrow space allowing little leverage for manual operation, thus, relieving the shortcoming of torque limitation when working with an L shape hexagonal spanner as well as saving the inexpediency of having to have at hand a piling of different size sleeving since one single speed spanner could suffice for working with all sizes of L-shape hexagonal spanners.

SUMMARY OF THE INVENTION

The primary object of the invention is to provide an adjunct for speed spanners, more specifically it relates to the design of an adjunct means or device facilitating the installation of any size of L-shape hexagonal spanner to the coupling adaptor of a prime speed spanner, to the grade hole furnished on one side of the adjunct means, and it is permissible to introduce, with reference to a given grading, a conventional L-shape hexagonal spanner, with sleeving appendant on the adjunct attached to the adaptor on the part of the prime speed spanner, so that the user may undo a fixed object nail or screw conveniently by swinging about the speed spanner reciprocally with substantial savings in manual exertions.

DETAILED DESCRIPTION OF THE PREFERRED EMBODIMENTS

Figure 2:
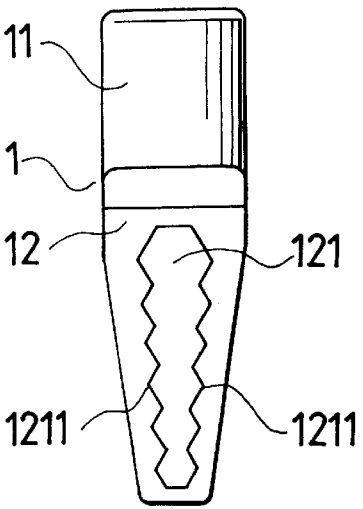
FIG. 2 is a right side view of the inventive adjunct device.
Figure 3:
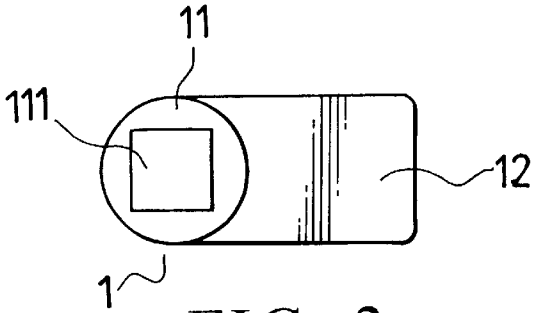
FIG. 3 is a top view of the inventive adjunct device.
Figure 1:
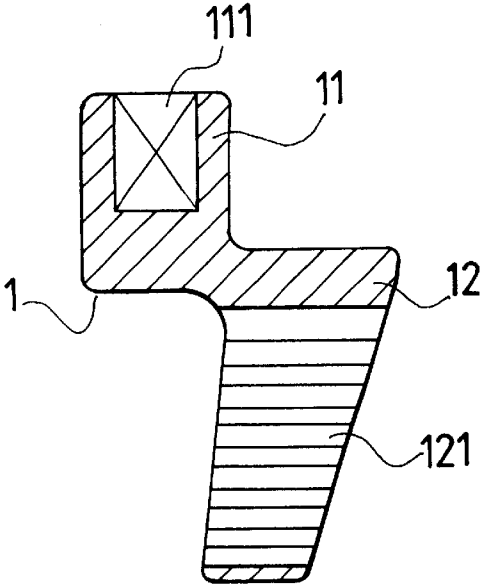
FIG. 1 is a frontal sectional view of the inventive adjunct device.
Figure 4:
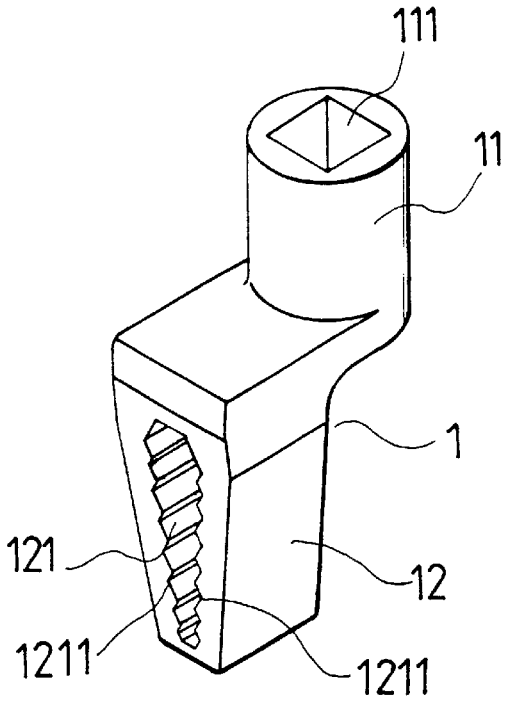
FIG. 4 is a three-dimensional view of the inventive adjunct device of one embodiment.

Referring to FIG. 1 through FIG. 4, it is seen that the invention, the design of an adjunct means or device to a speed spanner, comprises an adjunct 1 meant for use in conjunction with the L-shape hexagonal spanner 30 dependent on a prime speed spanner 20 and structurally it is a one-piece unit composed of a cylindrical sleeving 11 on top and a roughly rectangular mounting 12; the sleeving 11 being erected vertically, complete with a rectangular or polygonal blind hole 111 on top, the base of the sleeving 11 props eccentrically to form a roughly rectangular mounting 12, on one side of said mounting 12 there is a formation of a series of graded holes 121 whose axis is perpendicular to the axis of the sleeving 11, as is shown in FIG. 2 and FIG. 4. A series of graded holes 121 penetrates the mounting 12 and is composed of a number of serially indented but individually sized hexagonal holes in communication with one another, and on both walls of the series of graded holes 121 are formed with symmetrical indentations 1211, thus forming an adjunct executed according to this invention.

The invention adjunct 1 serves primarily to associate an L-shape hexagonal spanner 30 for integral use with the adaptor 201 of a prime speed spanner 20 (see illustration of FIG: 5); the adjunct 1 is coupled to the adaptor 201 down the speed spanner 20 by dint of the blind hole 111 on the sleeving 11, so that the adjunct 1 is linked to the speed spanner 20 because the adjunct 1 is thereby driven by the adaptor 201, to rotation, to be specific whereby the user may choose a conventional L-shape hexagonal spanner 30 and have it engaged by the shorter side or longer side, as appropriate, into the series of graded holes 121 relative to the mounting 12, to rest inserted upon the correspondingly contoured indentation 1211, while the axis of the work side of the same L-shape hexagonal spanner 30 sets concentric with the sleeving 11, so that the user, by inserting the work side of a conventional L-shape hexagonal spanner 30 into an object screw hole, followed by swinging manipulation of the prime speed spanner, also conventional, the object screw or nail can be easily undone, and the job is done.

The design of the invention adjunct 1 is unique in that ready integration of a conventional L-shape hexagonal spanner 30 with a prime speed spanner 20 can be made for convenient use, further that with the series of graded holes 121 of the adjunct 1 being composed of a plurality of individually sized hexagonal holes, the adjunct 1 may accommodate insertion of more differently sized L-shape hexagonal spanners 30 for combined operation. Where an L-shape hexagonal spanner 30 is inserted into the series of graded holes 121 on a shorter side, more torque is realizable by manipulating the speed spanner 20 so that easier undoing of an object screw or nail is possible by working with the L-shape hexagonal spanner 30; also, where the L-shape hexagonal spanner 30 is to be applied in a narrow space for operation, the possibility to swing the speed spanner 20 reciprocally will suffice to resolve the drawback of impracticability for the same L-shape hexagonal spanner 30 to rotate a full 360 degree cycle, and the object screw or nail to be undone with can be easily undone all the same, and that is the improvement achieved with the invention over prior arts.

Figure 5:
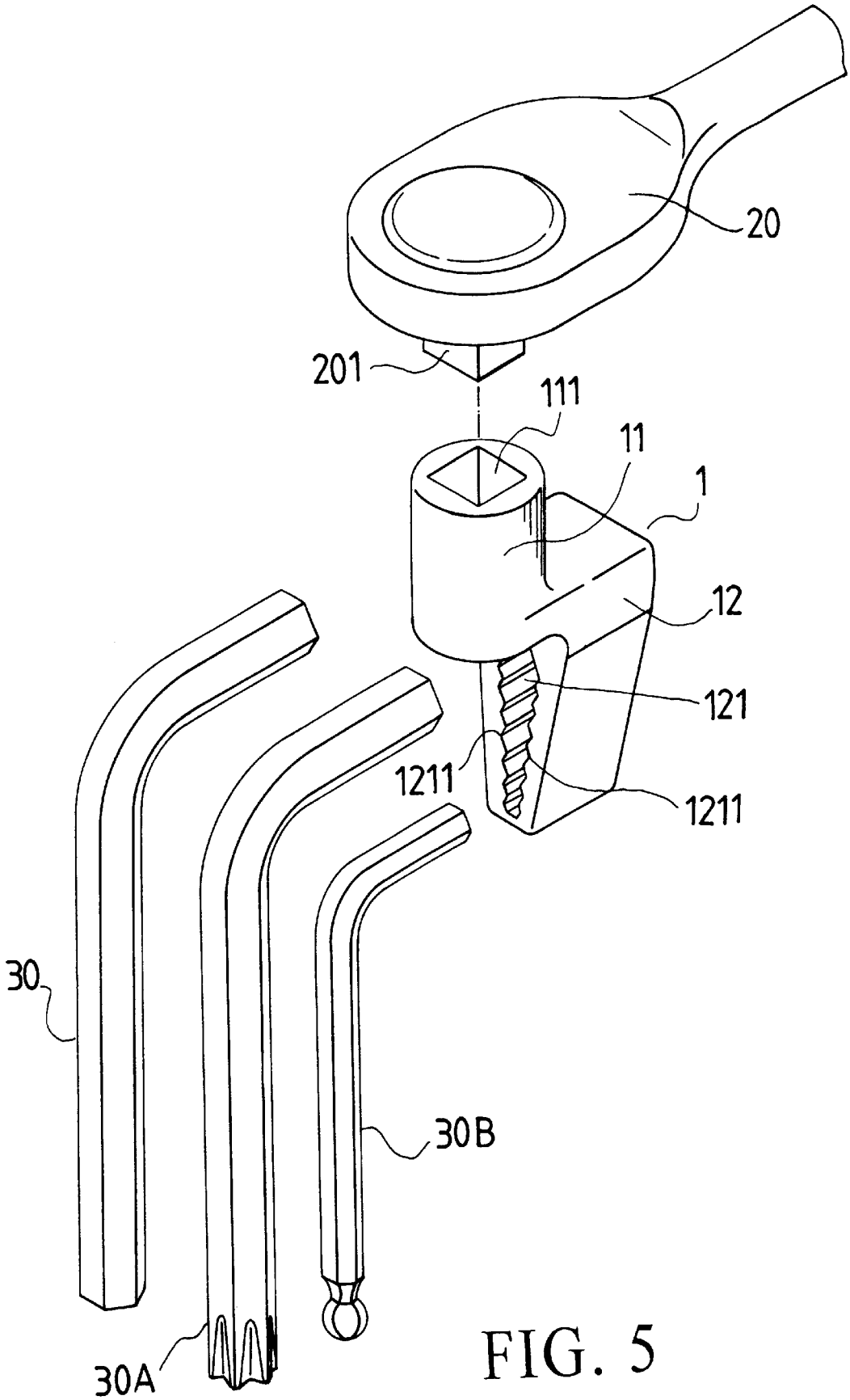
FIG. 5 is a three-dimensional perspective of the inventive adjunct device of one embodiment showing various attachments.

It is to be noted that the working side of the L shape spanner 30 which fits for insertion into the inventive series of graded holes 121 need not be categorically hexagonal, indeed all roughly termed hexagonal spanners will fit for the purpose of the invention for example the working side of the L-shape hexagonal spanner 30A as seen illustrated in FIG. 5 bears the profile of a plum blossom; as another example, the L shape hexagonal spanner 30B as shown bears a spheroidal tip on its working side.

Figure 6:
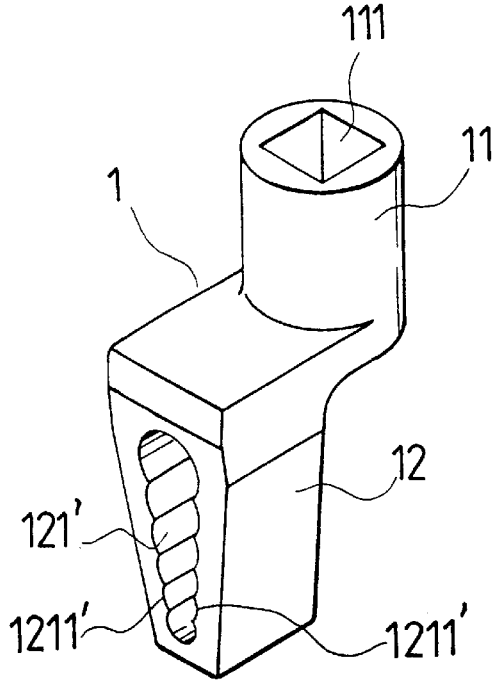
FIG. 6 is a three-dimensional perspective of another embodiment of the invention.
Figure 7:
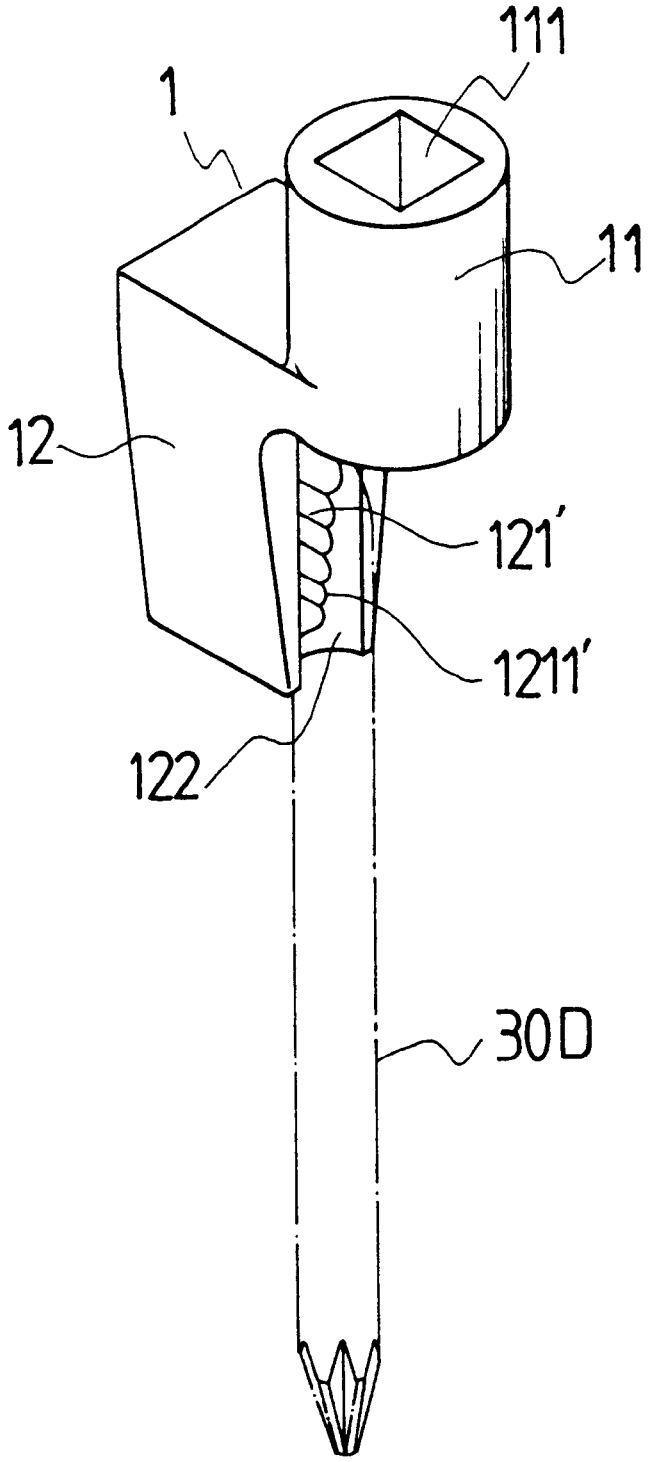
FIG. 7 is a three-dimensional perspective view showing the grade hole used according to another embodiment of the invention.
Figure 8:
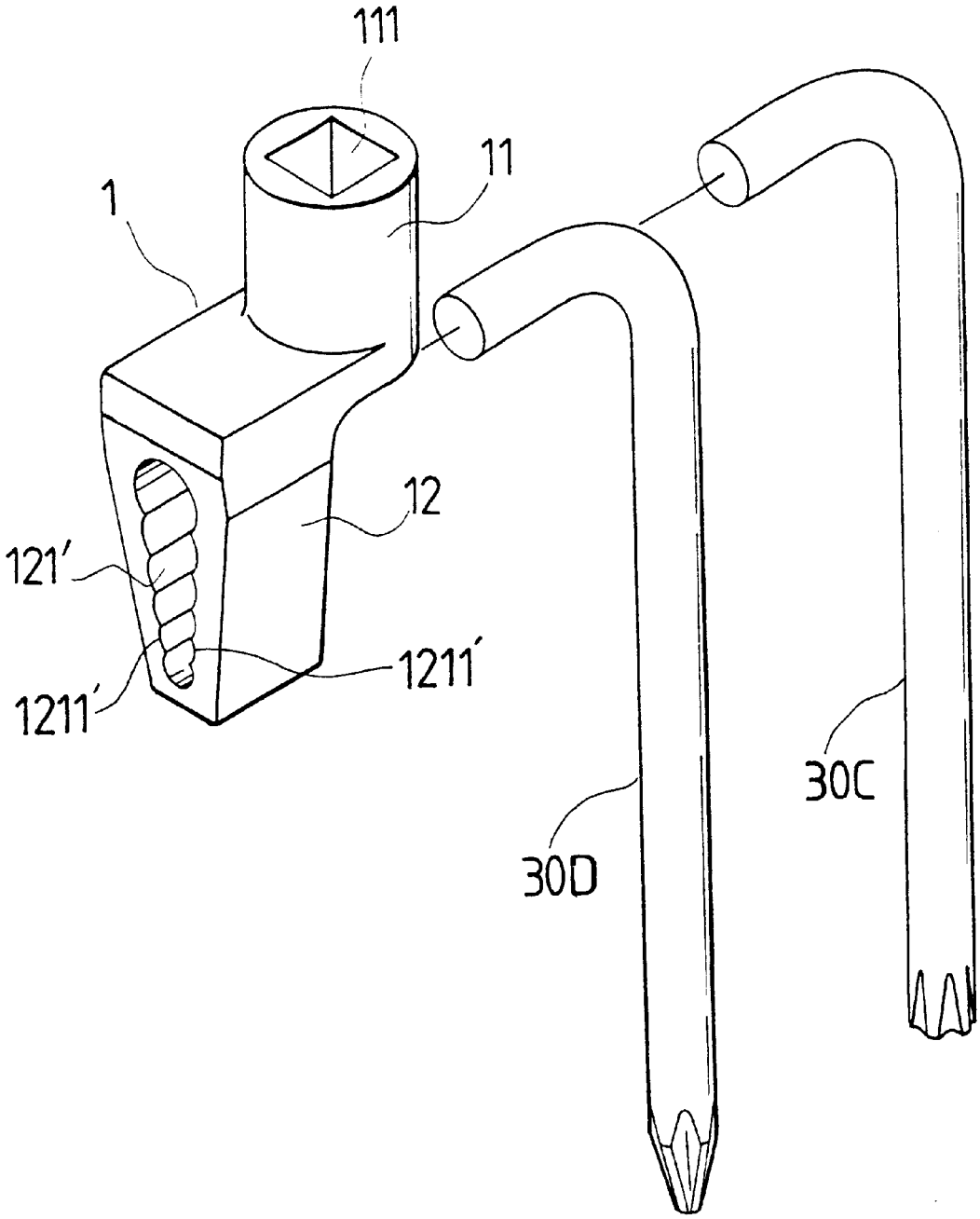
FIG. 8 is a three-dimensional analytical view of the grade hole for use with various attachments.
Figure 10:
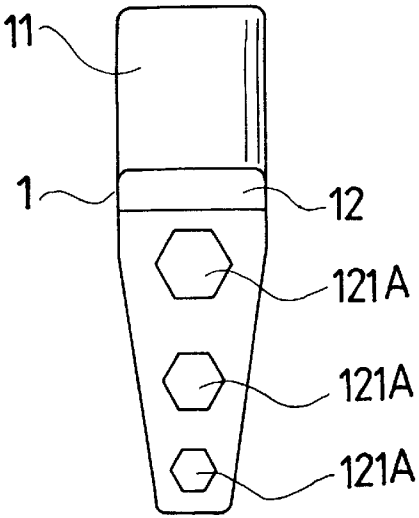
FIG. 10 is a side view of the hexagonal coupling hole according to the invention.
Figure 11:
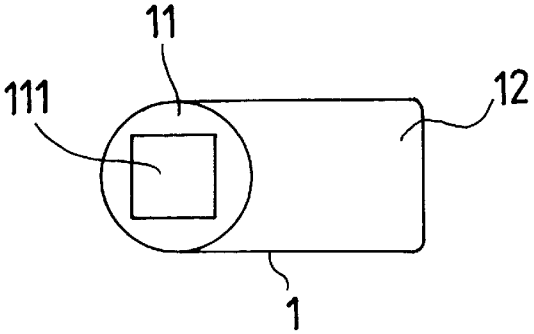
FIG. 11 is a top view of the hexagonal coupling hole according to the invention.
Figure 9:
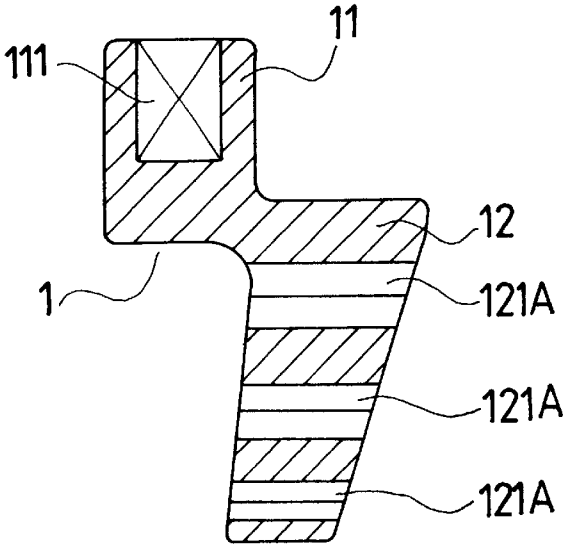
FIG. 9 is a cross-sectional view showing the hexagonal coupling hole according to the invention.
Figure 12:
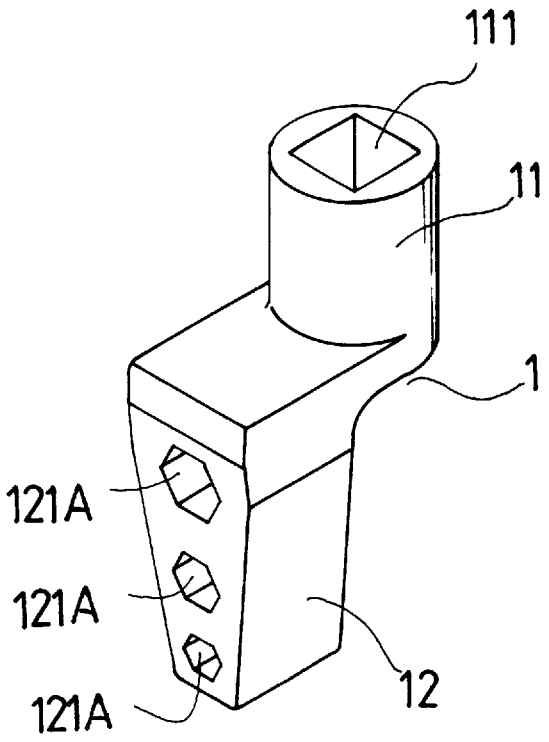
FIG. 12 is a three-dimensional perspective of the hexagonal coupling hole according to the invention.

Further, as illustrated in FIG. 6 and FIG. 7, the series of grade holes 121' designed pursuant to the invention can be in the form of a series of differently sized circular holes lining up serially, wall on both sides of the series of grade holes 121' being processed into arched coulisses 1211' with an inlay grooving 122 holed out centrally inside the assembly mounting 12, so that an L-shape cylindrical spanner 30D may rest reliably and safely into the arched coulisse 1211' about the series of grade holes 121', with the lever of the spanner 30D engaged in the inlay grooving 122, and in that manner, immobilized. Referring to FIG. 8, it is seen that the work end of the L-shape cylindrical spanner 30D bears a plum flower pattern whereby it is made easier to undo the hexagonal armpit nailing screw, or alternatively the work end of said L-shape cylindric spanner 30D may be treated to yield a cross design whereby cross-head screws may be undone with ease.

Figure 13:
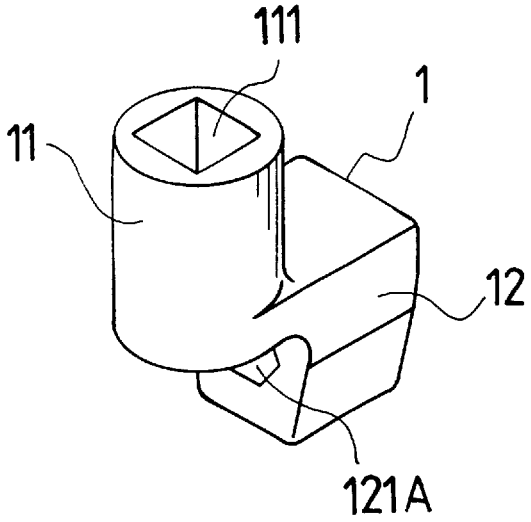
FIG. 13 is a three-dimensional perspective view of the hexagonal coupling hole according to another embodiment of the invention.

Referring now to FIG. 9 through FIG. 12, it will be appreciated that presentation on one side of the assembly mounting 12 may be in an alternative execution by arranging instead a plurality of differently sized hexagonal coupling holes 121A, with each coupling hole 121A penetrating said assembly mounting 12, and the axial core of each coupling hole 121A facing the axial direction of the sleeving 11 whereby an orthogonal intersection is attained, in that manner it will also facilitate mounting of the L-shape hexagonal spanner 30 which is then available for combined operation with the speed spanner 20; while it is just all right for only one said hexagonal coupling hole 121A to be provided on one side of the assembly mounting 12, such as is shown in FIG. 13, to achieve the same functional purposes as described hereinbefore.

Figure 14:
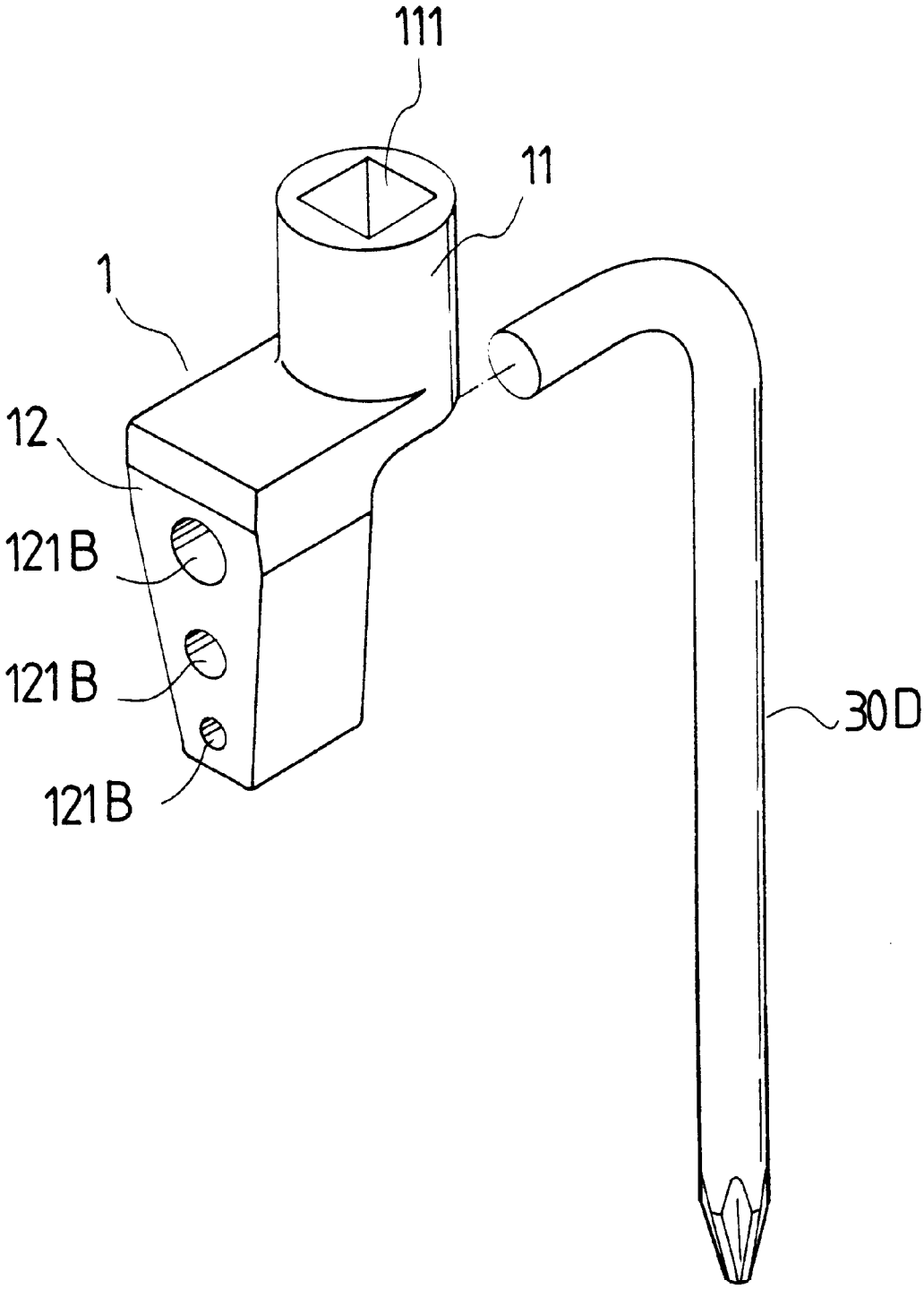
FIG. 14 is a three-dimensional view of a circular coupling hole according to the invention.
Figure 15:
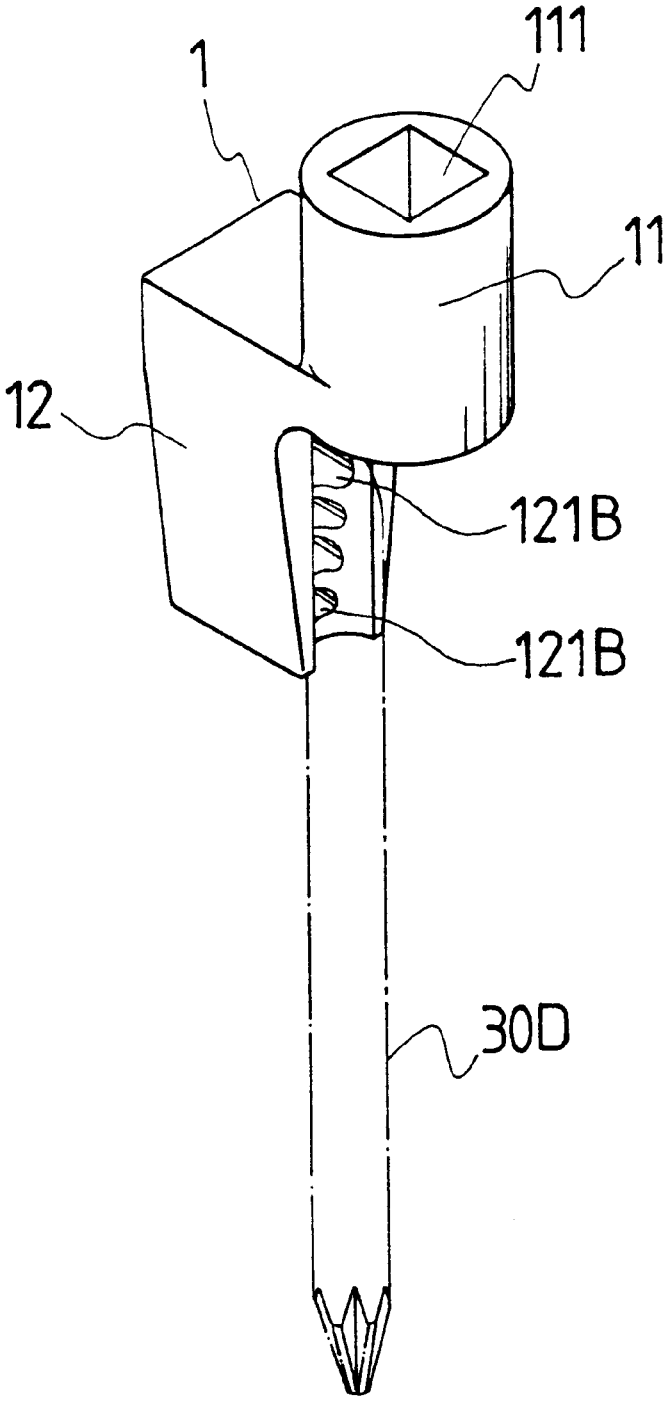
FIG. 15 is another three-dimensional perspective of a circular coupling hole according to the invention.
Figure 16:
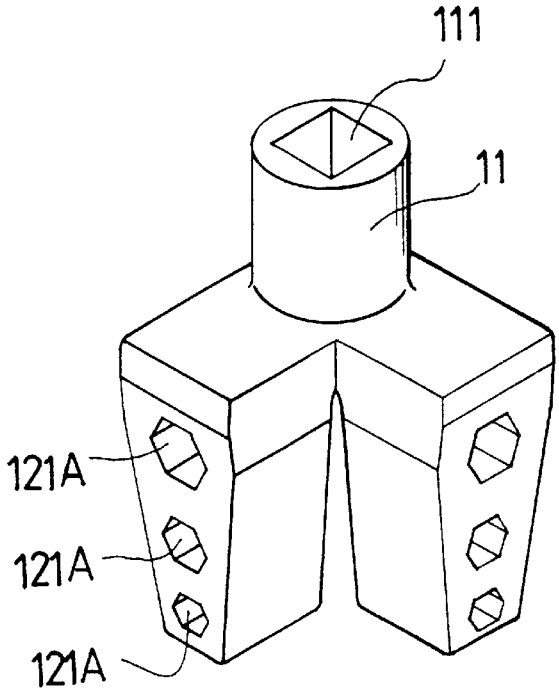
FIG. 16 is a three-dimensional illustration of the invention executed with two assembly mountings; and, FIG. 17 is another three-dimensional illustration of the invention executed with two assembly mountings.
Figure 17:
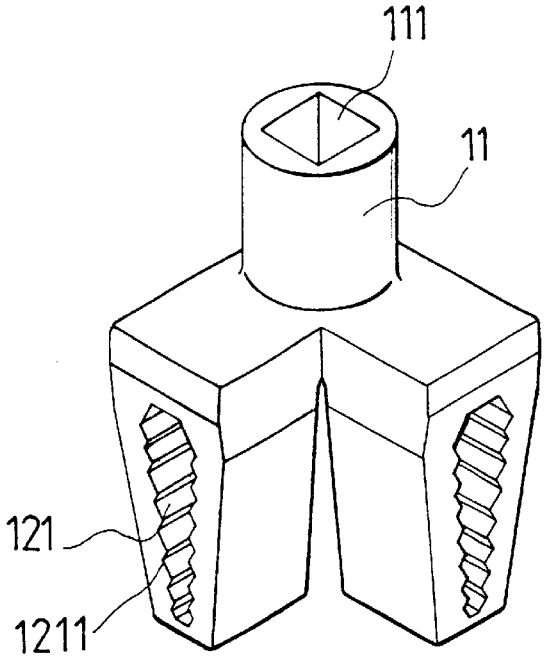

The assembly mounting 12 can still be designed so as to comprise a number of circular coupling hole 121 B, such as is shown in FIG. 14 and FIG. 15, complete with an inlay grooving, 122 provided centrally inside same, so that an L-shape cylinder spanner 30D may rest engaged inside said circular coupling hole 121B, and with the lever of the spanner 30D caught into the grooving 122 and there immobilized so as to facilitate combined operation with a conventional speed spanner 20. Further as shown in FIG. 16 and FIG. 17, the assembly mounting 12 according to the invention may be provided singly or plurally integral with the bottom side of the sleeving 11 to facilitate combined operation with one or more differently sized spanners 20; and accordingly, permitting easy alteration and replacement of the differently sized spanners, which is a feature characterizing this invention.

What is claimed is:

1. An adjunct to a speed spanner, the adjunct adapted as an auxiliary device that can integrally secure differently sized L-shape hexagonal spanners with a prime speed spanner for combined operation, the adjunct comprises:

an upright sleeving, the sleeving including a longitudinal axis, a top surface of said sleeving comprising a polygonal blind hole positioned along the longitudinal axis of the sleeving;

an assembly mounting extending from one side of said sleeving, the mounting comprising a series of graded holes extending substantially perpendicular to the longitudinal axis of said sleeving, the series of graded holes comprising a number of individually sized conterminous hexagonal holes; and the blind hole of the sleeving adapted to accommodate insertion of a coupling adaptor of a prime speed spanner and the series of graded holes are adapted to receive an L-shape hexagonal spanner of a suitable size, such that an L-shape spanner can be driven by a prime speed spanner.

2. The adjunct to a speed spanner according to claim 1, wherein said sleeving is cylindrical in shape.

3. The adjunct to a speed spanner according to claim 1, wherein said assembly mounting is substantially rectangular in shape.

4. The adjunct to a speed spanner according to claim 1, wherein said series of graded holes are formed by perforation across the assembly mounting.

5. The adjunct to a speed spanner according to claim 1, wherein said series of graded holes accommodate coupling engagement by an L-shape tubular spanner.

6. The adjunct to a speed spanner according to claim 1 or claim 5, further comprising a second assembly mounting that is integrally attached to a bottom of the sleeving.

7. An adjunct to a speed spanner, the adjunct adapted as an auxiliary device that can integrally secure differently sized L-shape hexagonal spanners with a prime speed spanner for combined operation, the adjunct comprises:

an upright sleeving, the sleeving including a longitudinal axis, a top surface of said sleeving comprising a polygonal blind hole positioned along the longitudinal axis of the sleeving;

an assembly mounting extending from one side of said sleeving, the mounting comprising at least two differently sized, sunken, hexagonal coupling holes, with an axial core of each of the coupling holes oriented substantially perpendicular to the longitudinal axis of the sleeving; and the blind hole of the sleeving adapted to receive a coupling adaptor of a speed spanner and one of the coupling holes is adapted to receive an L-shape hexagonal spanner of a suitable size, such that an L-shape spanner can be driven by a speed spanner.

8. The adjunct to a speed spanner according to claim 7, wherein said sleeving is cylindrical in shape.

9. The adjunct to a speed spanner according to claim 7, wherein said assembly mounting is rectangular in shape.

10. The adjunct to a speed spanner according to claim 7, wherein said coupling holes are formed by perforation across the assembly mounting.

11. The adjunct to a speed spanner according to claim 7, wherein said coupling holes accommodate coupling engagement by an L-shape tubular spanner.

12. The adjunct to a speed spanner according to claim 7 or claim 11, further comprising a second assembly mounting that is integrally attached to a bottom of the sleeving.

* * * * *